US005403689A

United States Patent [19]

Odell et al.

[11] Patent Number: 5,403,689

[45] Date of Patent: Apr. 4, 1995

[54] TONER COMPOSITIONS WITH POLYESTER ADDITIVES

[75] Inventors: Peter G. Odell; Richard P. N. Veregin, both of Mississauga; Maria N. V. McDougall, Burlington, all of Canada

[73] Assignee: Xerox Corporation, Stamford, Conn.

[21] Appl. No.: 119,939

[22] Filed: Sep. 10, 1993

[51] Int. Cl.[6] ..... G03G 9/097

[52] U.S. Cl. ..... 430/110

[58] Field of Search ..... 430/106, 109, 110

[56] References Cited

U.S. PATENT DOCUMENTS 3,590,000 6/1971 Palermiti et al. ..... 252/62.1
4,298,672 11/1981 Lu ..... 430/108
4,338,390 7/1982 Lu ..... 430/106
4,433,040 2/1984 Niimura et al. ..... 430/109
4,560,635 12/1985 Hoffend et al. ..... 430/106.6
4,812,381 3/1989 Bugner et al. ..... 430/110
4,845,003 7/1989 Kiriu et al. ..... 430/110
5,166,026 11/1992 Fuller et al. ..... 430/109
5,194,472 3/1993 Wilson et al. ..... 430/109
5,227,460 7/1993 Mahabadi et al. ..... 528/272
5,229,243 7/1993 Sasaki et al. ..... 430/109

*Primary Examiner*—John Goodrow
*Attorney, Agent, or Firm*—E. O. Palazzo

[57] ABSTRACT

A toner comprised of resin, pigment, and a polyester with amine functionality.

27 Claims, No Drawings

TONER COMPOSITIONS WITH POLYESTER ADDITIVES

BACKGROUND OF THE INVENTION

The invention is generally directed to toner and developer compositions, and more specifically, the present invention is directed to developer and toner compositions containing certain polyester additives, which function primarily as charge enhancing additives, and which can impart or assist in imparting a negative charge to the toner resin particles and enable toners with rapid admix characteristics. In embodiments, there are provided in accordance with the present invention toner compositions comprised of resin particles, especially polyester resins like SPAR TM, pigment particles, and a polyester with amine functionality in a polyester backbone. In embodiments, the present invention is directed to toners with charge additives of a component comprised of an amine functionally in a polyester backbone. The aforementioned component in embodiments of the present invention enable, for example, toners with a stable negative charge, rapid admix of less than about one minute, extended developer life, stable electrical properties, high image print quality with substantially no background deposits, and resistance to relative humidity. Also, the aforementioned toner compositions contain pigment particles comprised of, for example, carbon black, magnetites, or mixtures thereof, cyan, magenta, yellow, blue, green, red, or brown components, or mixtures thereof thereby providing for the development and generation of black and/or colored images. The toner compositions of the present invention in embodiments thereof possess excellent admix characteristics as indicated herein, and maintain their triboelectric charging characteristics for an extended number of imaging cycles exceeding, for example, 1,000,000 in a number of embodiments. The toner and developer compositions of the present invention can be selected for electrophotographic, especially xerographic, imaging and printing processes, including color processes.

Toners with polyester resins are known, reference for example U.S. Pat. No. 3,590,000, the disclosure of which is totally incorporated herein by reference. These and a number of other polyesters can be disadvantageous in that they do not effectively charge negatively at various humidity values, and their charge is sensitive to humidity to the extent that it can be reduced and adversely effect development. These and other disadvantages are avoided, or minimized with the invention of the present application in embodiments.

Developer compositions with charge enhancing additives, which impart a positive charge to the toner resin, including polyester resin, are known. Thus, for example, there is described in U.S. Pat. No. 3,893,935 the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchloride, tetrafluoroborate, benzene sulfonate, and the like. Also, in U.S. Pat. No. 4,221,856 there are disclosed electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example, sulfate, sulfonate, nitrate, borate, chlorate, and halogen, such as iodide, chloride and bromide, reference the Abstract of the Disclosure and column 3; a similar teaching is presented in U.S. Pat. No. 4,312,933 which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other patents disclosing positively charged toner compositions with charge control additives include U.S. Pat. Nos. 3,944,493; 4,007,293; 4,079,014; 4,394,430, and 4,560,635, which illustrates a toner with a distearyl dimethyl ammonium methyl sulfate charge additive.

The following United States patents were recited in a patentability search in the toner subject matter area: U.S. Pat. No. 4,812,381, which discloses toners and developers containing charge control agents comprising quaternary ammonium salts of the formula indicated, for example, in the Abstract of the Disclosure, wherein R is alkyl with from 12 to 18 carbon atoms, and the anion is a trifluoromethylsulfonate; also note, for example, the information presented in column 2 and beginning with column 3 of this patent; a similar teaching is presented in U.S. Pat. Nos. 4,834,921 and 4,490,455, which discloses toners with, for example, amine salt charge enhancing additives, reference the Abstract of the Disclosure, for example, and wherein A is an anion including those derived from aromatic substituted sulfonic acids, such as benzene sulfonic acid, and the like, see column 3, beginning at line 33; U.S. Pat. No. 4,221,856 directed to toners with a quaternary ammonium compound wherein A is an anion such as sulfate, sulfonate, nitrate, borate, chlorate, and certain halogens, see the Abstract of the Disclosure; U.S. Pat. Re. No. 32,883 (a reissue of U.S. Pat. No. 4,338,390) which illustrates toners with sulfate and sulfonate charge additives, see the Abstract of the Disclosure, wherein $R_4$ is an alkylene, and the anion contains a $R_5$ which is a tolyl group, or an alkyl group of from 1 to 3 carbon atoms, and n is the number 3 or 4; U.S. Pat. No. 4,323,634, which discloses toners with charge additives of the formulas presented in column 3, providing that at least one of the R's is a long chain amido group, and X is a halide ion or an organo sulfur containing group; U.S. Pat. No. 4,326,019 relating to toners with long chain hydrazinium compounds, wherein the anion A can be a sulfate, sulfonate, phosphate, halide, or nitrate, see the Abstract of the Disclosure for example; U.S. Pat. No. 4,752,550, which illustrates toners with inner salt charge additives, or mixtures of charge additives, see for example column 8; U.S. Pat. No. 4,684,596, which discloses toners with charge additives of the formula provided in column 3 wherein X can be variety of anions such as trifluoromethane sulfonate; and U.S. Pat. Nos. 4,604,338; 4,792,513; 3,893,935; 4,826,749, and 4,604,338. The disclosures of each of the aforementioned patents are totally incorporated herein by reference.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives. Also, toners with aluminum complex negative charge additives are illustrated in U.S. Pat. No. 4,845,003.

There is illustrated in U.S. Pat. No. 4,404,271 a method for developing electrostatic images with a toner which contains a metal complex represented by the formula in column 2, for example, and wherein ME can be chromium, cobalt or iron. Patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

Additionally, toners with charge additives are illustrated in a number of copending applications and patents, such as U.S. Pat. No. 5,275,900 wherein there are illustrated toner compositions comprised of polymer resins, colorants comprised of color pigment particles or dye molecules, and certain metal complex charge additives derived from the reaction of a mixture of a hydroxybenzoic acid and a base with a metal ion in the presence of an excess of a hydroxyphenol. More specifically, this copending application illustrates a negatively charged toner composition comprised of polymer, colorant, optional surface additives, and a metal complex charge enhancing additive of the following formula

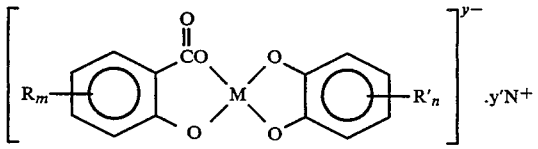

where M is a metal; N+ is a cation; R and R' are alkyl, alkoxy, aryloxy, halogen, carbonyl, amino, nitro, or mixtures thereof; m and n are the number of R substituents ranging from 0 to 3; y− is the magnitude of the negative charge of the anion; and y' represents the number of cations.

Illustrated in U.S. Pat. No. 5,300,387 is a negatively charged toner composition comprised of a polymer or polymers, pigment, and a metal complex charge enhancing additive as essentially represented by the following formula

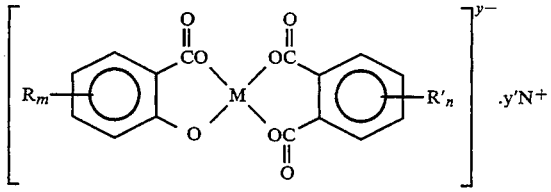

where M is the central metal ion; N+ is the countercation; R and R' are selected from the group consisting of alkyl, alkoxy, aryloxy, halogen, carbonyl group, alkoxycarbonyl group, amino group, nitro group or mixtures thereof; m and n are the number of R substituents on the aromatic rings, ranging from 0 to 3; y− is the magnitude of the negative charge of the anion or the number of the countercations of the metal complex, and represents the number 1 or 2; and y' represents the number of countercations N+; U.S. Ser. No. 964,544 (D/92402) discloses a toner composition comprised of a polymer or polymers, pigment particles and/or dyes, optional surface additives, and a charge enhancing additive of the following formula

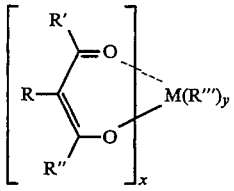

wherein R is hydrogen, alkyl, or aryl; R' and R'' are selected from the group consisting of alkyl, alkoxy, aryl, and aryloxy; R''' is selected from the group consisting of alkyl, alkoxy, oxide, and halide; M is boron or a metal; x is a number of from 1 to 4; and y is a number of from 0 to 2; and U.S. Pat. No. 5,290,651 discloses a negatively charged toner composition comprised of polymer, pigment, optional surface additives, and a zinc complex charge enhancing additive represented by either of the two following formulas

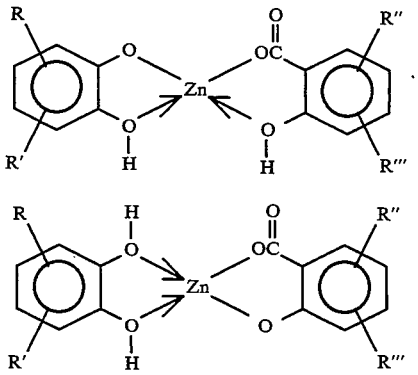

wherein R, R′, R″, and R‴ are independently selected from the group consisting of hydrogen, alkyl, aryl alkoxy, aryloxy, halogen, amino, and hydroxy. The disclosures of each of the aforementioned copending applications are totally incorporated herein by reference.

Illustrated in U.S. Pat. No. 5,250,381, the disclosure of which is totally incorporated herein by reference, is a negatively charged toner composition comprised of resin particles, pigment particles, and an aluminum salt of thiophenecarboxylic acid charge enhancing additive; and a negatively charged toner composition comprised of resin, pigment, and an aluminum salt charge enhancing additive of the following formula

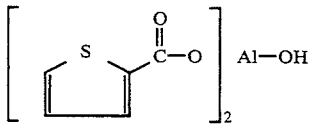

SUMMARY OF THE INVENTION

It is an object of the present invention to provide toner and developer compositions with many of the advantages illustrated herein.

In another object of the present invention there are provided negatively charged toner compositions useful for the development of electrostatic latent images including color images.

In yet another object of the present invention there are provided negatively charged toner compositions containing polyesters with amine functionality, which polyesters can function primarily as a charge additive, especially when the toner resin selected is a polyester.

Also, in another object of the present invention there are provided developer compositions with negatively charged toner particles, and carrier particles.

In yet a further object of the present invention there are provided humidity insensitive, from about, for example, 20 to 80 percent relative humidity at temperatures of from 60° to 80° F. as determined in a relative humidity testing chamber, negatively charged toner compositions with desirable admix properties of from about 15 seconds to about 2 minutes as determined by the charge spectrograph, and acceptable stable triboelectric charging characteristics of from about a negative 10 to about a negative 60 and preferably from about 10 to about 35 microcoulombs per gram as determined by the known Faraday Cage method.

Additionally, in a further object of the present invention there are provided negatively charged magnetic toner compositions.

Furthermore, in yet another object of the present invention there are provided developer compositions useful in a variety of electrostatic imaging and printing processes, including color xerography, and wherein there is selected a toner with a polymeric amine incorporated polyester as a charge coated additive, and which amine can be present in an amount of from about 4 to about 20 percent in embodiments.

Another object of the present invention resides in the formation of toners which will enable the development of images in electrophotographic imaging apparatuses, which images have substantially no background deposits thereon, are substantially smudge proof or smudge resistant, and therefore are of excellent resolution; and further, such toner compositions can be selected for high speed electrophotographic apparatuses, that is those exceeding 75 copies per minute.

These and other objects of the present invention can be accomplished in embodiments thereof by providing toner compositions comprised of resin or polymer, pigment particles, and certain polyesters. More specifically, the present invention in embodiments is directed to toner compositions comprised of resin, especially a polyester like SPAR TM, pigment, and a polyester with amine functionality preferably in the backbone.

In another embodiment of the present invention there are provided subsequent to known micronization and classification toner particles with an average diameter of from about 10 to about 20 microns.

Examples of polyesters with amine functionality include copoly[4,4′-isopropylidenebisphenyl bispropanol amine biester, N-phenyldiethanolamine]/fumaric acid; copoly[fumaric acid/propoxylated bisphenol A, N-phenyl-diethanolamine]; copoly[fumaric acid, adipic acid, terephthalic acid/(propoxylated bisphenol A, N-phenyl-diethanolamine)]; copoly[fumaric acid, glutaric acid, terephthalic acid/(propoxylated bisphenol A, N-phenyl-diethanolamine)]; copoly[fumaric acid, azelaic acid, isophthalic acid/(propoxylated bisphenol A, N-phenyl-diethanolamine)]; copoly[azelaic acid, isophthalic acid)/(propoxylated bisphenol A, N-phenyl-diethanolamine)]; copoly[terephthalic acid/(propoxylated bisphenol A, diethylene glycol, N-phenyl-diethanolamine)]; copoly[4,4′-isopropylidenebisphenyl bispropanol bisether, 2,6-dimethanol pyridine/fumaric acid]; copoly[fumaric acid/(propoxylated bisphenol A, 2,6-dimethanol pyridine)]; copoly[(azelaic acid, isophthalic acid)/(propoxylated bisphenol A, 2,6-dimethanol pyridine)]; and copoly[terephthalic acid/(-propoxylated bisphenol A, diethylene glycol, 2,6-dimethanol pyridine)].

The polymers or polyester amides of the present invention can be prepared by a number of methods depending, for example, on the specific product desired. Generally, the polyester amide polymers can be prepared by reacting about equal molar amounts of one or more diacids and one or more diols, and wherein there is included in the diol component one or more hydroxyl functionalized amines, and which reaction can be preferably accomplished in the presence of a known catalyst and a known stabilizer like hydroquinone. The aforementioned reactions are accomplished with heating. More specifically, the polymers of the present invention can be obtained by a general synthetic procedure which is acomplished in, for example, a reactor comprised of a 1 liter stainless steel shell equipped with a helical coil stirrer and a double mechanical seal, and driven by 0.5 hp motor with a 30:1 gear reduction, wherein the reactor was heated electrically, the pressure was monitored by both pressure transducer and pirani gauge, and the temperature was monitored by platinum RTDs. The pressure and temperature were precisely controlled and profiled by a Fischer and Porter Chameleon controller. A glass still head was used to collect the byproduct distillate. To this reactor was added:

| | | |
|---|---|---|
| Propoxylated 4,4′-isopropylidenebisphenol | 307.0 grams | 0.9 mole |
| N-phenyldiethanolamine | 18.1 grams | 0.1 mole |
| Fumaric acid | 116 grams | 1.0 mole |
| Titanium butoxide | 0.5 milliliter | |
| Hydroquinone | 0.4 gram | |

The reactor was then sealed and the temperature raised to about 50° C. at which time stirring was begun at a slow rate, which was later increased to about 20 rpm (revolutions per minute) when the temperature reached 100° C. The temperature was then increased to about 185° C. and retained for about 150 minutes, then the temperature was increased to about 215° C. and maintained there for about 280 minutes. During the heating, the reactor was slowly flushed with carbon dioxide gas. The reactor pressure was maintained at about atmospheric pressure for the first 300 minutes, and then lowered over the course of an hour to below 5 mbar with the carbon dioxide flow gradually being shut off during this time. The low pressure was maintained until the polymerization was terminated, approximately 60 minutes later. At the end of the reaction, the pressure was returned to atmospheric using carbon dioxide. The molten polymer was removed by means of a bottom drain valve. The obtained polymer, copoly[(4,4'-isopropylidenebisphenyl bispropanol bisether, N-phenyldiethanolamine)/fumaric acid] (0.45:0.05:0.5 molar) had a Tg of 62° C. as determined on an E. I. DuPont Instruments DSC 10. The GPC molecular weight averages were determined on a Waters chromatography system using a 100 Å, two 500 Å and a 104 Å Waters Ultrastryragel columns calibrated with narrow molecular weight polystyrene standards and found to possess a $M_n$=5,900 and a $M_w$=15,400. The product, copoly[(4,4'-isopropylidenebisphenyl bispropanol biester, N-phenyldiethanolamine)/fumaric acid], and its structure with random incorporation of the amine in the polyester backbone were confirmed by NMR. The combination of a titanium catalyst and a diethanolamine produces small amounts of an insoluble complex that appear as black flecks in the polymer, and to avoid this a tin catalyst may be employed. Thus, the above reaction may be repeated except that 0.46 gram of n-butylstannoic acid is used in place of titanium butoxide and the second heating plateau of 215° C. is accomplished in 180 minutes rather than 280, and essentially the same polymer with a Tg of 62° C. resulted.

The preferred range of amine loading in the polyester is from about 0.1 to about 10 weight percent. This may be accomplished by formulating all the polymer resin with the desired amount of amine directly, or by using a small amount, for example about 5 percent of the resin total, of a polyester with high level of amine, for example about 20 weight percent, to produce an overall amine loading of 1 percent.

Preferred amines include tertiary amines with hydroxyl functionality, and which amines permit incorporation into the polymer. A preferred degree of hydroxyl functionality is two which allows the amine moiety to be incorporated anywhere in the polyester backbone. Also, in embodiments a hydroxyl functionality of 1, which would incorporate the amine at the the polymer chain ends, or a hydroxyl functionality of 3, which would introduce a crosslink in the polymer, can be selected. Generally, examples of amines are compounds of the general formula $NR_1R_2R_3$, wherein $R_1$, $R_2$ and $R_3$ can be alkyl aryl, cycloalkyl, haloalkyl, haloaryl, arylalkyl, and where from 1 to 3 R's have a hydroxyl function. Alkyl includes components with from 1 to about 25, and preferably 1 to about 12 carbon atoms, such as methyl, ethyl, propyl, butyl, pentyl, hexyl, heptyl, octyl, and the like; and aryl includes components with from 6 to about 30 carbon atoms like phenyl, naphthyl, benzyl, and the like. Halo includes chlorine, bromine, iodine, and fluorine.

Specific examples of amines include N-phenyl-diethanolamine, 2,6-dimethanol pyridine, di-N-phenylethanolamine, N-methyl-diethanolamine, tertiary-N-butyl-dipropanolamine, N-butyl-dipropanolamine, diisopropylethanolamine, diethylethanolamine, phenylethylethanolamine, dimethylamino-2-methyl-1-propanol, dimethylisopropanolamine, triethanolamine, and triisopropanolamine.

The toner compositions of the present invention can be prepared by a number of known methods such as admixing and heating resin particles such as polyesters, pigment particles such as magnetite, carbon black, or mixtures thereof, and preferably from about 0.5 percent to about 5 percent of the amine polyester in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with in embodiments a volume median diameter of less than about 25 microns, and preferably of from about 5 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

Illustrative examples of suitable toner resins selected for the toner and developer compositions of the present invention include polyamides, polyolefins, styrene acrylates, styrene methacrylate, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like. Specific toner resins include styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, and homopolymers of the aformentioned styrene polymers, may be selected.

As one toner resin, there are selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; PLIOLITES®; suspension polymerized styrene butadienes, reference U.S. Pat. No. 4,558,108, the disclosure of which is totally incorporated herein by reference; polyester resins obtained from the reaction of bisphenol A and propylene oxide, followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Other preferred polyesters are illustrated in U.S. Ser. No. 814,641, and U.S. Pat. No. 5,227,460 , the disclosures of which are totally incorporated herein by reference. Also, waxes with a molecular weight of from about 1,000 to about 20,000, such as polyethylene, polypropylene, and paraffin waxes, can be included in, or on the toner compositions as fuser roll release agents.

The resin particles are present in a sufficient, but effective amount, for example from about 70 to about 99 weight percent. Thus, when 1 percent by weight of the amine polyester additive is present, and 10 percent by weight of pigment or colorant, such as carbon black, is contained therein, about 89 percent by weight of resin is selected. The polyester with amine functionality is present in various effective amounts, such as from about 0.1 to about 15 weight percent, and preferably from about 1 to about 3 weight percent in embodiments.

Numerous well known suitable pigments or dyes can be selected as the colorant for the toner particles including, for example, carbon black like REGAL 330®, VULCAN™ carbon blacks, and the like, nigrosine dye, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles may be selected.

When the pigment particles are comprised of magnetites, thereby enabling single component toners in some instances, which magnetites are a mixture of iron oxides ($FeO \cdot Fe_2O_3$) including those commercially available as MAPICO BLACK®, they are present in the toner composition in an amount of from about 10 percent by weight to about 75 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50weight percent can be selected.

There can also be blended with the toner compositions of the present invention external additive particles including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

Also, there can be included in the toner compositions of the present invention low molecular weight waxes, such as polypropylenes and polyethylenes commercially available from Allied Chemical and Petrolite Corporation, EPOLENE N-15™ commercially available from Eastman Chemical Products, Inc., VISCOL 550-P™, a low weight average molecular weight polypropylene available from Sanyo Kasei K. K., and similar materials. The commercially available polyethylenes selected can have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Included within the scope of the present invention are colored toner and developer compositions comprised of toner resin particles, optional carrier particles, the charge enhancing additives illustrated herein, and as pigments or colorants red, blue, green, brown, magenta, cyan and/or yellow particles, as well as mixtures thereof. More specifically, with regard to the generation of color images utilizing a developer composition with the charge enhancing additives of the present invention, illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5rdimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts. In embodiments, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles of the present invention are selected in embodiments to be of a positive polarity enabling the toner particles, which are negatively charged in embodiments, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in embodiments in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR ® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 microns, and preferably from about 75 microns to about 125 microns, thereby permitting them to possess, for example, sufficient density and inertia to avoid adherence to the electrostatic images during the development process. The carrier component can be mixed with the toner composition in various suitable combinations, such as from about 1 to 5 parts per toner to about 100 parts to about 200 parts by weight of carrier.

The toner and developer compositions of the present invention may be selected for use in electrostatographic imaging apparatuses containing therein conventional photoreceptors. Thus, the toner and developer compositions of the present invention can be used with layered photoreceptors that are capable of being charged negatively or positively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Other similar photoreceptors can be selected providing the objectives of the present invention are achievable.

The toner compositions are usually jetted and classified subsequent to preparation to enable toner particles with a preferred average volume diameter of from about 5 to about 25 microns, and more preferably from about 8 to about 12 microns. Also, the toner compositions of the present invention preferably possess a triboelectric charge of from about a negative 0.2 to a negative 2 femtocoulombs per micron in embodiments thereof as determined by the known charge spectograph. Admix time for the toners of the present invention are preferably from about 15 seconds to about 1 minute, and more specifically from about 15 seconds to about 30 seconds in embodiments thereof as determined by the known charge spectograph. These toner compositions with rapid admix characteristics enable, for example, the development of images in electrophotographic imaging apparatuses, which images have substantially no background deposits thereon, even at high toner dispensing rates in some instances, for instance of 25 grams per minute; and further, such toner compositions can be selected for high speed electrophotographic apparatuses, that is those exceeding 75 copies per minute.

The following Examples are being provided to further define various species of the present invention, it being noted that these Examples are intended to illustrate and not limit the scope of the present invention. Parts and percentages are by weight unless otherwise indicated.

EXAMPLE I

Polyester Synthesis

The reactor employed was a 1 liter stainless steel reactor equipped with a helical coil stirrer and a double mechanical seal, which reactor was driven by 0.5 hp motor with a 30:1 gear reduction. The reactor was heated electrically, and the pressure was monitored by both pressure transducer and a pirani gauge. The temperature was monitored by platinum RTD's. The pressure and temperature were precisely controlled and profiled by a Fischer and Porter Chameleon controller. A glass still head was used to collect the byproduct distillate. To this reactor was added:

| | | |
|---|---|---|
| Propoxylated 4,4'-isopropylidenebisphenol | 307 grams | 0.9 mole |
| N-phenyldiethanolamine | 18.1 grams | 0.1 mole |
| Fumaric acid | 116 grams | 1.0 mole |
| Titanium butoxide | 0.5 milliliter | |
| Hydroquinone | 0.4 gram | |

The reactor was sealed and the temperature increased to about 50° C. at which time stirring was initiated at a slow rate, 3 rpm, which was later increased to about 20 rpm when the temperature reached 100° C. The temperature was then increased to about 185° C. and retained there for about 150 minutes, then the temperature was raised to about 215° C. and maintained there for about 280 minutes. During heating, the reactor was slowly flushed with carbon dioxide gas. The reactor pressure was maintained at about atmospheric pressure for the first 300 minutes and then lowered over the course of an hour to about 4 mbar with the carbon dioxide flow gradually being shut off during this time. The low pressure was maintained until the polymerization was terminated, approximately 60 minutes later. At the reaction termination, the pressure was returned to atmospheric using carbon dioxide. The molten polymer was removed by means of a bottom drain valve. The obtained polymer, copoly[(4,4'-isopropylidenebisphenyl bispropanol bisether, N-phenyldiethanolamine)/fumaric acid] (0.45:0.05:0.5 molar) had a Tg of 62° C. as determined on an E. I. DuPont Instruments DSC 10. The GPC molecular weight averages were determined on a Waters chromatography system using a 100 Å, two 500 Å and a 104 Å Waters Ultrastryragel columns calibrated with narrow molecular weight polystyrene standards and found to be a $M_n=5,900$ and a $M_w=15,400$. NMR confirmed the structure.

EXAMPLE II

Toner Fabrication

The following materials were dry mixed in a Waring blender: copoly[4,4'-isopropylidenebisphenyl bispropanol bisether/fumaric acid] (SPAR II TM), 5.6 grams; copoly[(4,4'-isopropylidenebisphenyl bispropanol bisether, N-phenyl-diethanolamine)/fumaric acid] (0.45:0.05:0.5 molar) of Example I as a charge additive, 4.0 grams; and PV FAST BLUE TM, 0.4 gram. This mixture was extruded at 150° C. and at 90 rpm in a Custom Scientific Instruments Extruder. The resulting toner was then broken up in a Waring blender and passed through a No. 80 sieve and jetted with a Gem T research model Trost Impact Pulverizer.

EXAMPLE III

To disperse about 3 percent or less of the total weight initiator, to obtain a more uniform product there were added dropwise to 100 grams of copoly[4,4'-isopropylidenebisphenyl bispropanol bisether/fumaric acid] (SPAR II TM) 0.6 gram of t-butyl hydroperoxide initiator. Further dispersion of the peroxide into the polyester was achieved by dry mixing in a Waring blender. The peroxide/polyester mixture was then extruded at 120° C. and 90 rpm in a Custom Scientific Instruments Extruder. This product was reground in the Waring blender, and it was confirmed by analytical methods, such as IR, that the peroxide did not react under these conditions.

EXAMPLE IV

A second toner, about 8 microns in average volume diameter, was fabricated by the process of Example II with the following materials copoly[4,4'-isopropylidenebisphenyl bispropanol bisether/fumaric acid] (SPAR II TM), 11.6 grams; SPAR II TM containing the peroxide (of Example III), 7.0 grams; copoly[(4,4'-isopropylidenebisphenyl bispropanol bisether, N-phenyl-diethanolamine)/fumaric acid] (0.45:0.05:0.5 molar) of Example I, 4.0 grams as a charge additive; and PV FAST BLUE TM, 0.4 gram.

EXAMPLE V

Toner Charging Evaluation

The toner triboelectric charge-to-mass ratio, Q/M, was measured using the standard tribo blow-off method after the toner and carrier had been equilibrated in various relative humidity zones. The developer composition comprised of 0.5 gram of toner and 25 grams of carrier were mixed for 15 minutes. The carrier was comprised of 100 micron ferrite particles of copper zinc coated with a terpolymer of 81 percent by weight of methyl methacrylate, 14 percent by weight of styrene, and 5 percent by weight of vinyl triethoxysilane. The toner Q/M was then measured, as was the admix time, that is the time for 0.5 gram of uncharged toner to reach the charge of the fully charged developer composition. The charging characteristics are summarized in Table 1. Table 1 illustrates the toner triboelectric charge Q/M in μC/gram as a function of the relative humidity, from 20 percent relative humidity to 80 percent relative humidity at 20° C. Toners containing polyester charge additive with 0.25 percent of amine, and 1 percent of amine have a more negative charge in all relative humidity zones and a much lower relative humidity sensitivity, as measured by the ratio of the charge of the toner at 20 percent relative humidity to that at 80 percent relative humidity, than the comparable control toner prepared with copoly[4,4'-isopropylidenebisphenyl bispropanol bisether/fumaric acid] (SPAR II TM) with the same pigment and pigment loading. The surface charge density in attocoulomb/$\mu m^2$ is also shown to enable comparison of toners with different particle size. When the surface charging properties of two toners are identical, then the surface charge densities should be the same, even if the particle sizes are different. However, the value of Q/M will vary with particle size. The surface charge density is calculated as D/3 * (Q/M). Thus, the toner charge can be compared from surface charge densities, which corrects for particle size. The surface charge density is quantitatively different with regard to the absolute differences in the charge of the two toners, but shows the same trends, a more negative charge in all relative humidity zones for the toners incorporating the amine polyester charge additive of the present invention. The difference is particularly dramatic at high relative humidity where the charge is about 4 times higher with the addition of 1 percent of the amine. The humidity sensitivity, usually measured by the ratio of the charge at 20 percent relative humidity to that at 80 percent relative humidity, is greatly reduced in the amine polyester containing toner by a factor that increases with the amount of the amine. The charge ratio improves by increasing by a factor of about 3 times in the inventive Example polyester amine with 1 percent of amine, compared to the comparative control toner with no amine. The admix was also measured for the two toners, indicating that the amine incorporation does not have any detrimental effect on the admix of the toner.

Both the more negative charge in all relative humidity zones, and the much lower humidity sensitivity of the charge are very desirable, as SPAR TM, and polyesters in general tend to have low negative charge and high relative humidity sensitivity at high relative humidity.

TABLE 1

| Amine wt % of the Polyester Resin | Toner Size | Toner Charging Properties: Q/M at Different % Relative Humidity in μC/g | | | | Surface Charge Density at Different % Relative Humidity in aC/$\mu m^2$ | | | | Admix at 50% RH in Seconds |
|---|---|---|---|---|---|---|---|---|---|---|
| | | 20 | 50 | 80 | 20/80 | 20 | 50 | 80 | 20/80 | |
| 0 | 8.5 | −27 | −5.5 | −4.9 | 5.5 | −76 | −16 | −14 | 5.5 | 15 |
| 0.25 | 7.6 | −56 | −31 | −21 | 2.7 | −142 | −78 | −53 | 2.7 | 15 |
| 1.00 | 7.2 | −37 | −29 | −22 | 1.7 | −89 | −70 | −53 | 1.7 | 15 |

Other embodiments and modifications of the present invention may occur to those skilled in the art subsequent to a review of the information presented herein; these embodiments and modifications, as well as equivalents thereof, are also included within the scope of this invention.

What is claimed is:

1. A toner comprised of a polyester resin, pigment, and as a charge enhancing additive a polyester with amine functionality.

2. A toner composition in accordance with claim 1 wherein the polyester resin is selected from the group consisting of copoly(4,4'-isopropylidenebisphenyl bispropanol bisether)/fumaric acid; copoly[(fumaric acid, adipic acid, terephthalic acid)/propoxylated bisphenol A]; copoly[(fumaric acid, glutaric acid, terephthalic acid)/propoxylated bisphenol A]; copoly[(fumaric acid, azelaic acid, isophthalic acid)/propoxylated bisphenol A]; copoly[(fumaric acid, terephthalic acid)/(propoxylated bisphenol A, diethylene glycol)]; copoly[(fumaric acid, terephthalic acid)/(propoxylated bisphenol A, 2,2,4-trimethylpentane-1,3-diol)]; copoly[fumaric acid/tetrabromobisphenol dipropoxy ether]; copoly[(fumaric acid, sebacic acid)/tetrabromobisphenol dipropoxy ether]; copoly[(fumaric acid, sebacic acid)/tetrabromobisphenol dipropoxy ether, dipropylene glycol)]; copoly[(azelaic acid, isophthalic acid)/propoxylated bisphenol A]; copoly[terephthalic acid/(propoxylated bisphenol A, diethylene glycol)]; and copoly[terephthalic acid/(propoxylated bisphenol A, 2,2,4-trimethylpentane-1,3-diol)].

3. A toner composition in accordance with claim 1 wherein the polyester with amine functionality is selected from the group consisting of copoly(4,4'-isopropylidenebisphenyl bispropanol bisether, N-phenyldiethanolamine)/fumaric acid); copoly[fumaric acid/(propoxylated bisphenol A, N-phenyl-diethanolamine)]; copoly[fumaric acid, adipic acid, terephthalic acid/(propoxylated bisphenol A, N-phenyl-diethanolamine)]; copoly[fumaric acid, glutaric acid, terephthalic acid/(propoxylated bisphenol A, N-phenyl-diethanolamine)]; copoly[fumaric acid, azelaic acid, isophthalic acid/(propoxylated bisphenol A, N-phenyl-diethanolamine)]; copoly[azelaic acid, isophthalic acid)/(propoxylated bisphenol A, N-phenyl-diethanolamine)]; copoly[terephthalic acid/(propoxylated bisphenol A, diethylene glycol, N-phenyl-diethanolamine)]; copoly[4,4'-isopropylidenebisphenyl bispropanol bisether, 2,6-dimethanol pyridine/fumaric acid]; copoly[fumaric acid/(propoxylated bisphenol A, 2,6-dimethanol pyridine)]; copoly[azelaic acid, isophthalic acid/(propoxylated bisphenol A, 2,6-dimethanol pyridine)]; and copoly[terephthalic acid/(propoxylated bisphenol A, diethylene glycol, 2,6-dimethanol pyridine)].

4. A toner composition in accordance with claim 1 wherein the amine functionality is present in an amount of from about 0.1 to 10 weight precent.

5. A toner composition in accordance with claim 1 wherein the amine functionality is a tertiary amine with hydroxyl functionality.

6. A toner composition in accordance with claim 1 wherein the amine functionality is N-phenyl-diethanolamine, 2,6-dimethanol pyridine, di-N-phenyl-ethanolamine, N-methyl-diethanolamine, tertiary-N-butyl-dipropanolamine, N-butyl-dipropanolamine, diisopropylethanolamine, diethylethanolamine, phenylethylethanolamine, dimethylamino-2-methyl-1-propanol, dimethylisopropanolamine, triethanolamine, or triisopropanolamine.

7. A toner composition in accordance with claim 1 wherein the polyester with amine functionality acts primarily as a negative charge enhancing additive.

8. A toner composition in accordance with claim 1 wherein the polyester with amine functionality is present in an amount of from about 0.5 to about 30 weight percent.

9. A toner composition in accordance with claim 7 wherein the polyester is incorporated into the toner.

10. A toner composition in accordance with claim 7 wherein the polyester is present on the surface of the toner composition.

11. A toner composition in accordance with claim 1 with an admix time of from about 15 seconds to about 2 minutes.

12. A toner composition in accordance with claim 1 with a negative triboelectric charge of from about 10 to about 60 microcoulombs per gram.

13. A toner composition in accordance with claim 1 wherein the resin is comprised of styrene acrylates, styrene methacrylates, or styrene butadienes.

14. A toner composition in accordance with claim 1 containing a wax component with a weight average molecular weight of from about 1,000 to about 10,000.

15. A toner composition in accordance with claim 14 wherein the wax component is selected from the group consisting of polyethylene and polypropylene.

16. A toner composition in accordance with claim 1 containing as external additives metal salts of a fatty acid, colloidal silicas, metal oxides, or mixtures thereof.

17. A toner composition in accordance with claim 1 wherein the pigment is carbon black, magnetites, or mixtures thereof, cyan, magenta, yellow, red, blue, green, brown, or mixtures thereof.

18. A developer composition comprised of the toner composition of claim 1 and carrier particles.

19. A developer composition in accordance with claim 18 wherein the carrier particles are comprised of ferrites, steel, or an iron powder.

20. A developer composition in accordance with claim 18 wherein the carrier particles are comprised of a core with a polymer coating thereover.

21. A developer composition in accordance with claim 20 wherein the coating is comprised of a methyl terpolymer, a polyvinylidine fluoride, a polymethyl methacrylate, or a mixture of polymers not in close proximity in the triboelectric series.

22. A toner composition in accordance with claim 1 wherein the ratio of triboelectric charge at 20 percent relative humidity to the triboelectric charge at 80 percent relative humidity is from about 0.1 to about 1.3.

23. A method of imaging which comprises formulating an electrostatic latent image on a positively charged photoreceptor, affecting development thereof with the toner composition of claim 1, and thereafter transferring the developed image to a suitable substrate.

24. The toner consisting essentially of a polyester resin, pigment, and a polyester with amine functionality, which amine functionality is present in the backbone of said polyester.

25. A toner in accordance with claim 24 wherein said polyester with amine functionality acts as a negative charge enhancing additive.

26. A toner composition in accordance with claim 3 wherein said polyester functions as a negative charge enhancing additive.

27. A toner composition in accordance with claim 26 wherein said polyester functioning as a negative charge enhancing additive is copoly[4,4'-isopropylidenebisphenyl bispropanol bisether, N-phenyldiethanolamine)/fumaric acid].

* * * * *